US006526687B1

(12) United States Patent
Looney

(10) Patent No.: US 6,526,687 B1
(45) Date of Patent: Mar. 4, 2003

(54) GUN REST

(76) Inventor: James F. Looney, 2728 Brockton Rd., Jefferson, GA (US) 30549

( * ) Notice: Subject to any disclaimer, the term of this patent is extended or adjusted under 35 U.S.C. 154(b) by 0 days.

(21) Appl. No.: 09/972,097

(22) Filed: Oct. 5, 2001

(51) Int. Cl.[7] ..... F41A 29/00
(52) U.S. Cl. ..... 42/94
(58) Field of Search ..... 42/94; 89/37.04; 269/156; 211/64

(56) References Cited

U.S. PATENT DOCUMENTS

| | | | | | |
|---|---|---|---|---|---|
| D203,680 | S | * | 2/1966 | Allison | D30/1 |
| 3,473,673 | A | * | 10/1969 | Porter | 211/64 |
| 3,703,123 | A | | 11/1972 | Horn | 89/40 E |
| 4,026,057 | A | | 5/1977 | Cady | 42/94 |
| 4,548,392 | A | | 10/1985 | Rickling | 269/156 |
| 4,607,772 | A | * | 8/1986 | Hancock | 224/413 |
| 4,972,619 | A | | 11/1990 | Eckert | 429/94 |
| 5,070,636 | A | | 12/1991 | Mueller | 42/94 |
| 5,081,783 | A | | 1/1992 | Jarvis | 42/94 |
| 5,497,575 | A | * | 3/1996 | Fried | 42/94 |
| 5,697,181 | A | * | 12/1997 | Savant | 211/64 |
| 5,979,099 | A | * | 11/1999 | Kervin | 42/94 |
| 6,044,747 | A | * | 4/2000 | Felts | 42/94 |
| 6,269,578 | B1 | * | 8/2001 | Callegari | 297/172 |
| 6,305,117 | B1 | * | 10/2001 | Hales, Sr. | 42/94 |
| 6,338,218 | B1 | * | 1/2002 | Hegler | 42/94 |

FOREIGN PATENT DOCUMENTS

| | | | | |
|---|---|---|---|---|
| GB | 7149 | * | 4/1898 | 89/37.04 |
| GB | 28656 | * | 12/1911 | 89/37.04 |

OTHER PUBLICATIONS

Shooting Times Contents, May 1987, vol.25/No. 5, p. 36 the photograph.*

* cited by examiner

*Primary Examiner*—Michael J. Carone
*Assistant Examiner*—Denise J Buckley
(74) *Attorney, Agent, or Firm*—Kenneth S. Watkins, Jr.

(57) ABSTRACT

A gun rest [101] comprises a fore stock support assembly [103] supported from a support surface [127] and a butt stock support assembly [105] attached to a connecting beam [107] pivotally connected to the tripod support assembly by a pivot pin [123]. A butt stock height adjustment screw [135], attached to the connecting beam and engaging the support surface allows adjustment of the butt stock height above the support surface independent of the fore stock height. The device includes elevation and adjustment mechanisms for the fore stock height adjustment assembly and attachment holes for securing the fore stock height adjustment assembly to the support surface.

18 Claims, 5 Drawing Sheets

GUN REST

BACKGROUND OF THE INVENTION

The present invention relates to gun rests, and more particularly, to gun rests for sighting rifles and handguns.

Gun rests are useful tools for accurately sighting rifles and handguns. Accurate sighting and adjustment of the gun sights is especially critical for long-range sport and competitive shooting. In long range shooting, even very minor variations in gun or cartridge setup can make a significant difference in bullet location, so it is especially important for the gun rest used to be stable and produce consistent results every time the gun is fired. It is also necessary for the gun rest to allow comfortable and consistent positioning of the operator in order to produce consistent results.

In the past, sand bags placed on a stable bench or other support surface have provided a suitable tool for sighting guns. With increased gun performance and range, more sophisticated devices utilizing support stands and vices have become common.

An example of a gun sighting device is given in U.S. Pat. No. 5,070,636. The sighting assembly comprises a longitudinally extending frame for attachment to a conventional table or bench. A barrel rest assembly and a stock receiving cradle are attached to the frame for support of the gun. Multiple resilient absorption features absorb shock as the weapon is fired.

While theses and other gun rest devices provide support for the gun, they fail to fully provide allowance for comfortable and repeatable positioning of the shooter when using the device.

OBJECTS AND SUMMARY OF THE INVENTION

Therefore, an object of the present invention is to provide a gun rest that allows consistent and stable positioning of the operator while using the gun rest to improve repeatability of shooting conditions.

Another object of the present invention is to provide a gun rest that may be mounted securely to a stable platform such as a shooting table or bench.

Another object of the present invention is to provide a gun rest that provides stable support of the fore stock and butt stock of the gun.

Another object of the present invention is to provide a gun rest that allows independent adjustment of the height of the butt stock support and the fore stock height above the support surface.

Another object of the present invention is to provide a gun rest that provides elevation and windage adjustments to the fore stock rest.

Another object of the present invention is to provide a gun rest that proves a low slung support beam to provide sufficient clearance between the gun receiver portion and the support beam to allow loading or replacement of magazines.

Another object of the present invention is to provide a gun rest that proves longitudinal adjustment of the butt stock support to allow use with various gun designs.

Another object of the present invention is to provide a gun rest that may be used with handguns, pistols or rifles.

Another object of the present invention is to provide a gun rest that folds up or is easily disassembled for convenient storage.

Another object of the present invention is to provide a gun rest having components that are easily removed for storage or replacement.

Still another object of the present invention is to provide a gun rest that is durable and is simple to manufacture.

The gun rest of the present invention comprises a fore stock support assembly and a butt stock support assembly connected by an elongated longitudinal connecting beam. A first end portion of the connecting beam is pivotally connected to the fore stock support assembly. The butt stock support assembly is attached to the second end portion of the connecting beam. A butt stock height adjustment means connected to the connecting beam allows independent adjustment of the height of the butt stock and the fore stock of the gun.

In the preferred embodiments, the fore stock support assembly comprises a tripod leg assembly and an adjustable fore stock rest assembly. The adjustable fore stock rest assembly comprises an elevation height adjustment screw, a windage adjustment screw, and a fore stock rest. The butt stock support assembly comprises a U or V-shaped butt stock rest connected by a vertical post or rest extension to the connecting beam. The connecting beam is pivotally connected to the aft leg of the tripod near the bottom of the leg. In this manner, the connecting beam is sufficiently below the butt stock and receiver portion to allow unobstructed access to the trigger and magazines of the rifle.

In the preferred embodiments, the but stock height adjustment means is an adjustment screw threaded into complementary threads of the connecting beam so the end of the adjustment screw contacts the support surface. In other embodiments, the butt height adjustment means can be a cam or lever height adjuster, a scissors-type height adjuster or other type of linear actuator. In still other embodiments, the butt stock height adjustment means is a pivot locking device which locks the connecting beam in the desired position relative to the fore stock support assembly. The legs of the tripod leg assembly comprise hold down screw holes or slots to allow clamping of the legs to a bench or table to provide stable support of the device.

In the preferred embodiments, a butt stock support longitudinal position adjustment means provides a method for adjusting the longitudinal position of the butt stock support along the connecting beam. Longitudinal adjustment of the butt stock rest allows a wide variety of guns to be used with the device.

BRIEF DESCRIPTION OF THE DRAWINGS

These and other features, aspects and advantages of the present invention will become better understood with regard to the following description, appended claims and accompanying drawings, where:

DESCRIPTION OF THE PREFERRED EMBODIMENTS

The following is a description of the preferred embodiments of a gun rest having an independently supported pivoting beam for adjustment of the butt stock height.

Figure 1:
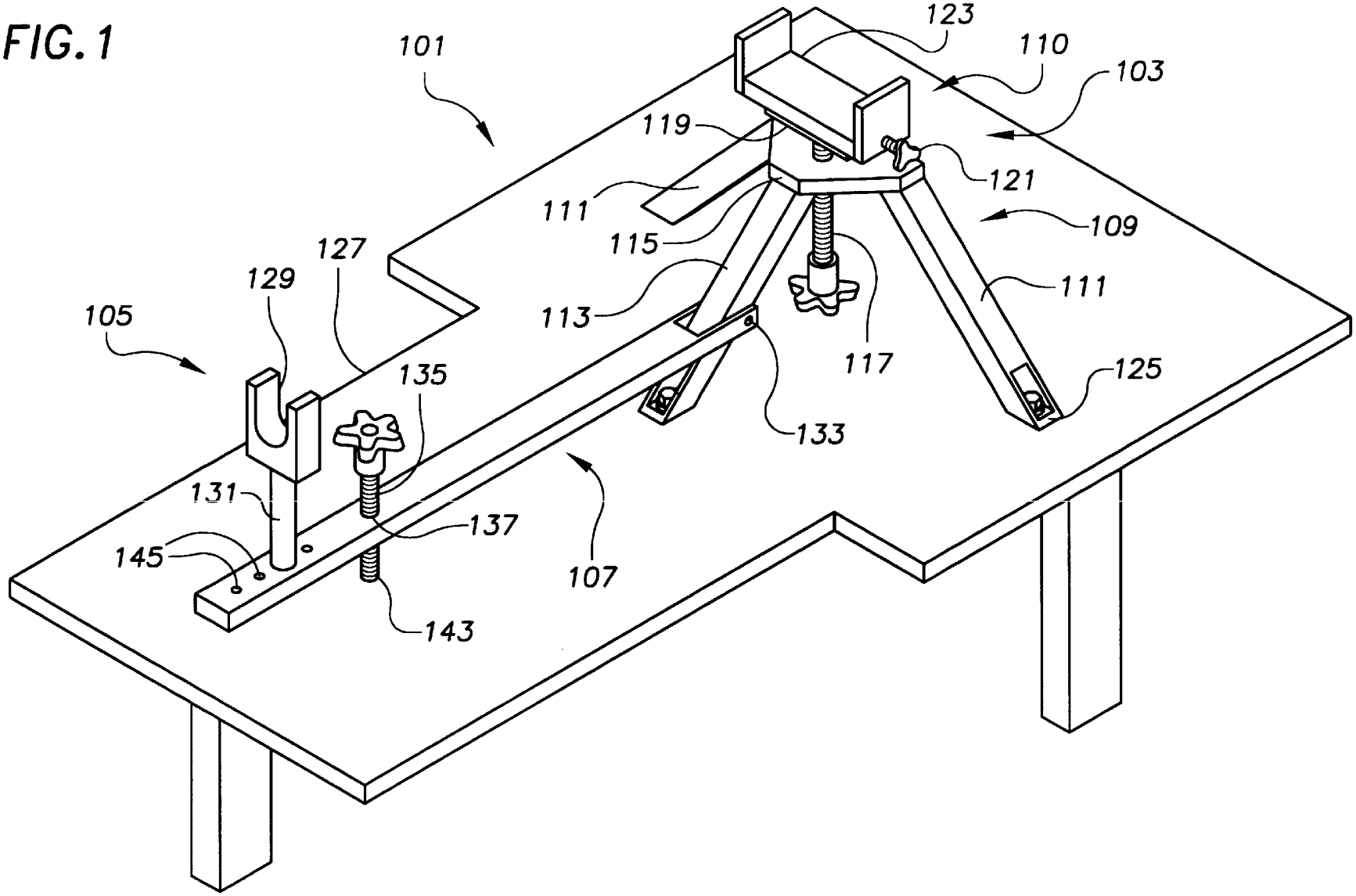
FIG. 1 is a perspective drawing of the gun rest of the present invention showing the fore stock support assembly with elevation and windage adjustment screws, the butt stock support assembly connected to the connecting beam and a pivot pin attachment of the connecting beam to the fore stock support assembly.

FIG. 1 is a perspective drawing of embodiment 101 of the gun rest comprising a fore stock support assembly 103, a butt stock support assembly 105, and a pivoted connecting beam 107. In the preferred embodiments, fore stock support assembly 103 comprises a tripod leg assembly 109 and an adjustable fore stock rest assembly 110. Tripod leg assembly 109 consists of two fore legs 111, an aft leg 113, and a tripod attachment plate 115.

Adjustable fore stock rest assembly 110 is supported from tripod attachment plate 115 of tripod leg assembly 109 and consists of elevation adjustment screw 117, fore stock support plate 119, windage adjustment screw 121, and fore stock rest 123. Attachment holes 125 in fore legs 111 and aft leg 113 provide positive attachment to a support surfaces such as bench top 127.

Butt stock support assembly 105 is attached to connecting beam 107 and includes U-shaped butt rest 129 and butt rest extension 131. Pivot pin or bolt 133 pivotally attaches connecting beam 107 to the lower portion of aft leg 113. Bolt 133 engages matching holes in connecting beam 107 and aft leg 113. Butt stock height adjustment screw 135 engages complementary threads 137 in connecting beam 107 to raise or lower beam 107 by turning knob 135A of screw 135. Bottom end 143 of screw 135 engages support surface 127. Multiple attachment holes 145 of connecting beam 107 allow longitudinal adjustment of butt stock support assembly 105 position.

Figure 2:
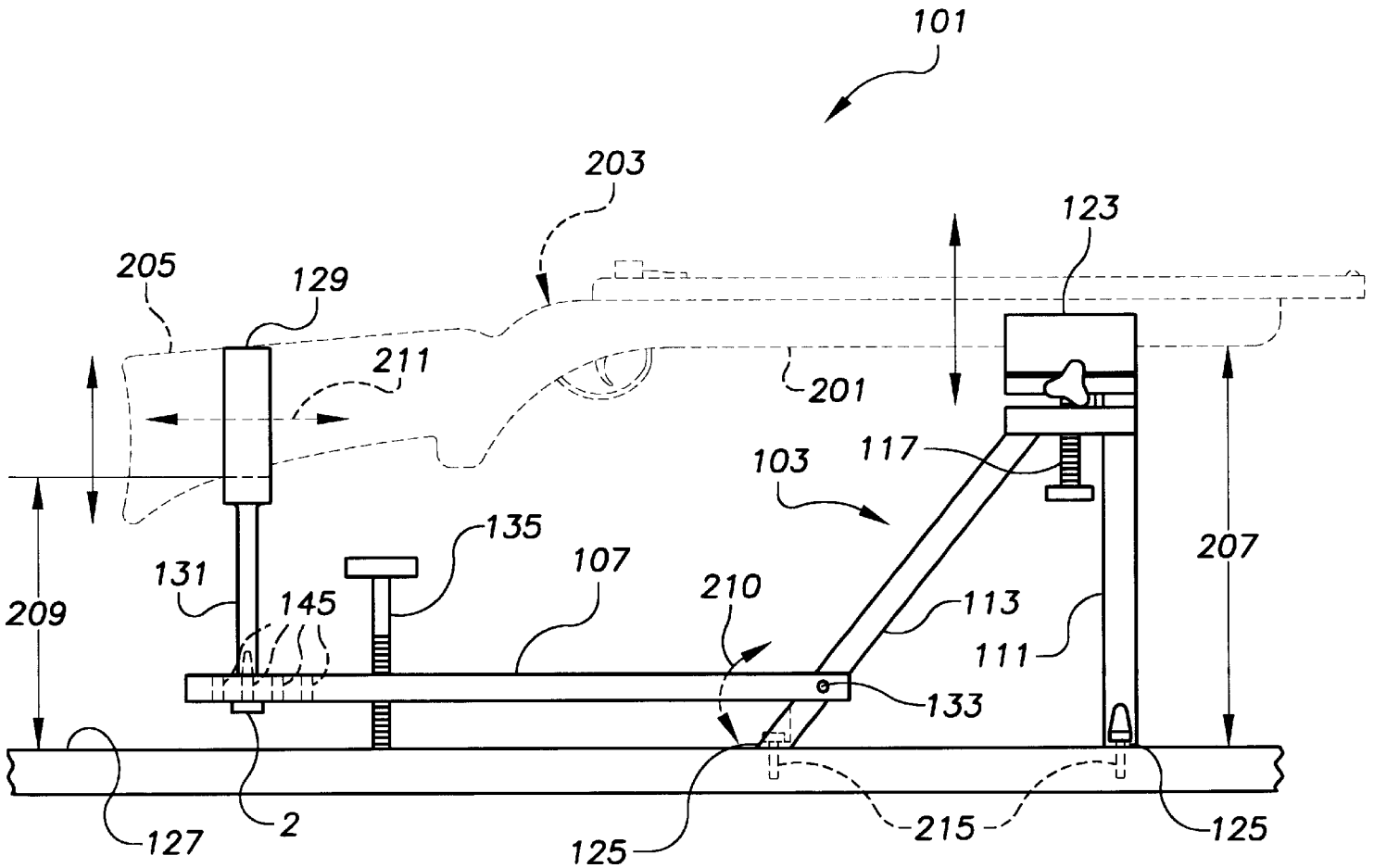
FIG. 2 is a side elevation drawing of the gun rest of FIG. 1 supporting a rifle from the fore stock support assembly and the butt stock support assembly

FIG. 2 is a side elevation drawing of gun rest 101 showing the fore stock 201 of rifle 203 supported in fore stock rest 123 of fore stock support assembly 103. Butt stock rest 129, attached to connecting beam 107 by extension 131 supports the butt stock 205 of rifle 203. Extension 131 supports butt stock 205 sufficiently above connecting beam 107 so that there is adequate clearance between the trigger guard area and receiver portion of rifle 203 to allow loading and use of the rifle. In practice, butt stock extension 131 should be at least equal to the height of the U or V-shaped portion of butt rest 129 to provide the necessary clearance. In the more preferred embodiments, butt stock extension 131 should be at least 1.5 or 2 times the height of the U or V-shaped portion of butt rest 129.

Elevation screw 117 adjusts elevation or height 207 of fore stock rest 123 for sighting rifle 203. Butt stock height adjustment screw 135 adjusts the height 209 of butt stock rest 129 independent of fore stock rest height 207 by pivoting 210 connecting beam 107 about pivot bolt 133. Independent adjustment of butt stock height 209 is important in providing a comfortable and repeatable position of butt stock 205 for the user. Multiple attachment holes 145 provide longitudinal adjustment 211 of butt stock rest 129. In other embodiments a sliding bracket (not shown) attached to the bottom of butt stock rest extension 131 and engaging connecting beam 107 provides longitudinal adjustment of butt stock rest 129.

Leg attachment screws 215 attach legs 111 and 113 of fore stock support assembly 103 to support surface 127 by engagement of attachment holes 125.

Figure 3:
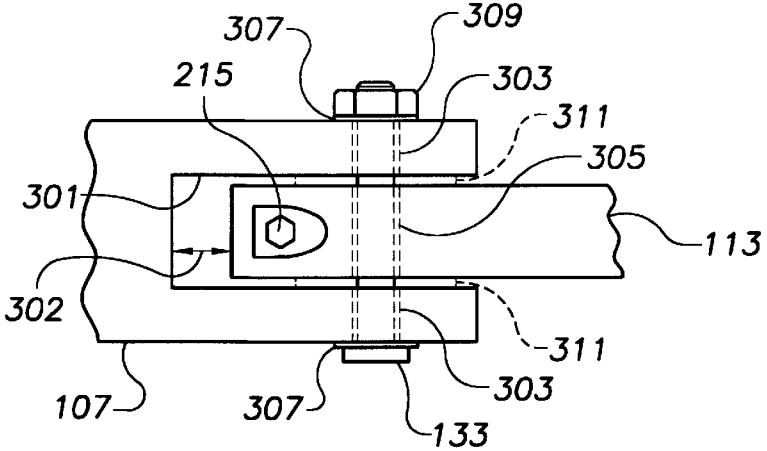
FIG. 3 is a detail elevation drawing of the pivot pin connecting the connecting beam to the aft leg of the tripod leg assembly.

FIG. 3 is a detail top elevation drawing of connecting pivot bolt 133 pivotally attaching connecting beam 107 to the bottom portion of aft leg 113. U-shaped cutout 301 of connecting beam 107 allows clearance 302 for pivoting of beam about leg 113. Pivot bolt 133, inserted in holes 303 of connecting beam 107 and 305 of aft leg 113 provide rotating bearing surfaces. Washers 307 and nut 309 secure pivot bolt 133 in the assembly. In other embodiments, a hinge (not shown) or other pivoting mechanical fastener connects connecting beam 107 to fore stock support assembly 103. In still other embodiments, friction shims or washers 311, shown in phantom lines, provide a locking means to lock connecting beam 107 in the desired position when nut 309 is tightened sufficiently.

Figure 4:
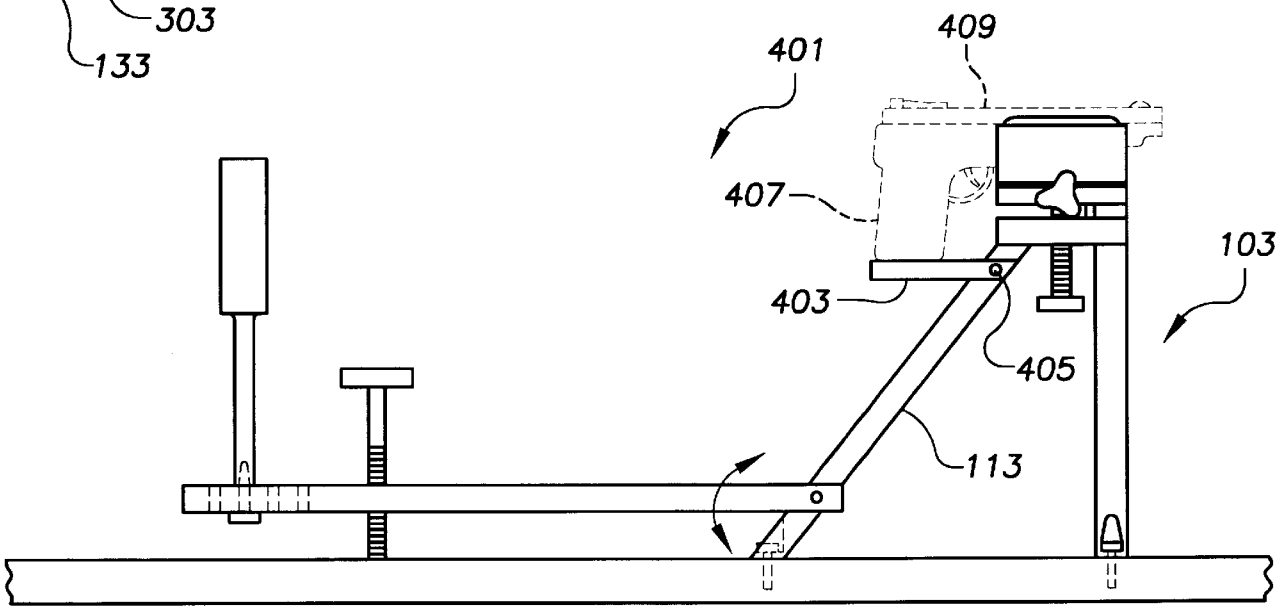
FIG. 4 is a side elevation drawing of the gun rest of FIG. 1 supporting a handgun from the fore stock support assembly.

FIG. 4 is a side elevation view of an alternative embodiment of gun rest 401 comprising a handgun butt stock rest 403 fastened to an upper portion of aft leg 113 of fore stock support assembly 103. Handgun butt stock rest 403 comprises a U-shaped cutout similar to that of FIG. 3 except that clearance 302 is eliminated to provide a stable, horizontal platform for support of handgun butt stock 407 of pistol 409. Bolt 405 secures butt stock rest 403 to aft leg 113.

Figure 5:
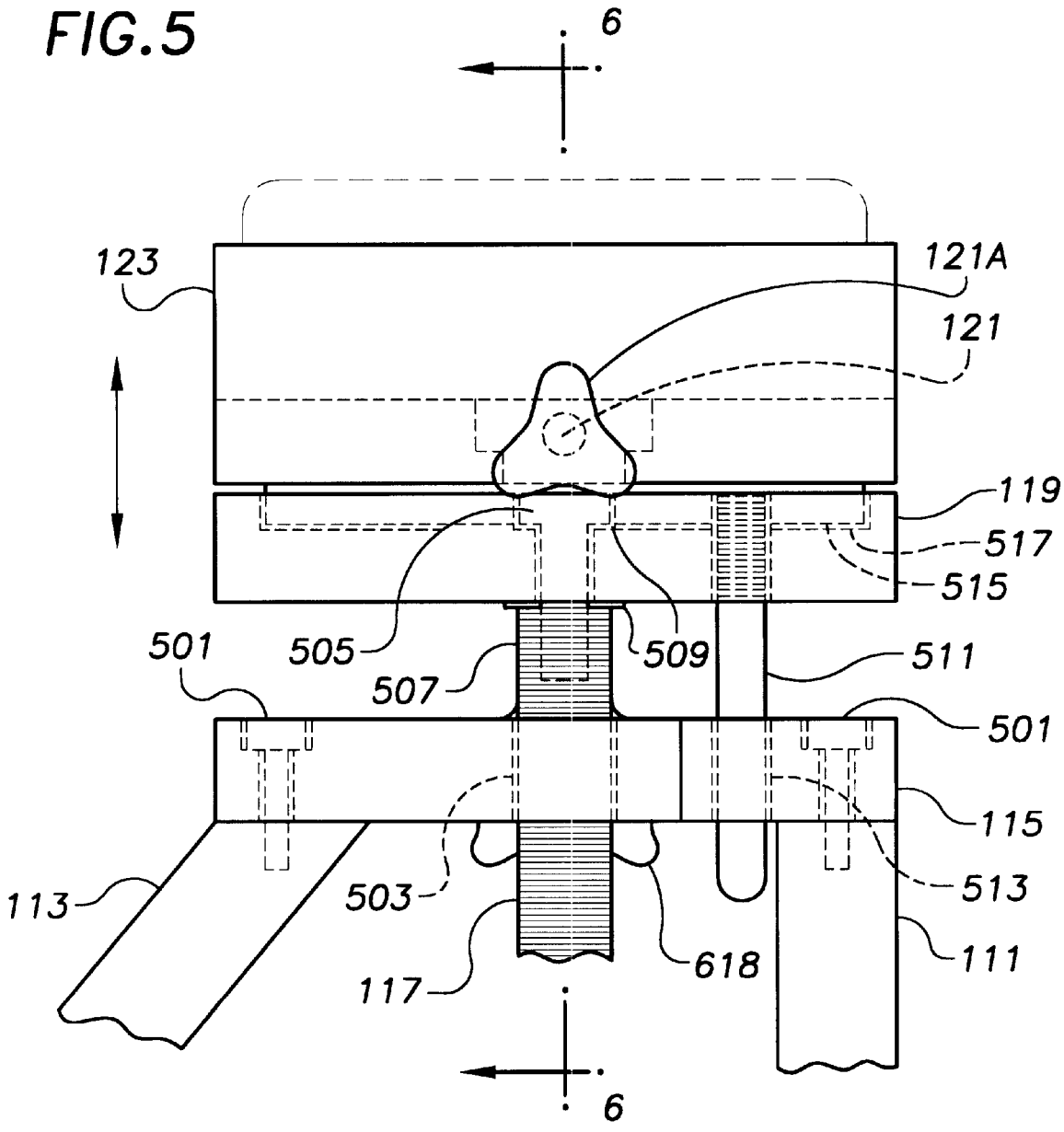
FIG. 5 is a detail side elevation drawing of the gun rest of FIG. 1 showing the adjustable fore stock support assembly with elevation and windage adjustment screws.

FIG. 5 is a detail side elevation view of the upper portion of fore stock support assembly 103 showing leg attachment bolts 501 securing legs 111 and 113 to tripod attachment plate 115. Elevation adjustment screw 117 engages threads 503 of plate 115 to raise and lower fore stock support plate 119. End screw 505, threaded into end 507 of elevation adjustment screw 117 secures adjustment screw 117 to support plate 119. Washers 509 allow rotation of elevation adjustment screw 117 relative to support plate 119. Anti-rotation pin 511, threaded into support plate 119 prevents rotation of support plate 119 when engaging hole 513 of tripod attachment plate 115.

Windage adjustment screw 121, attached to windage adjustment knob 121A provides transverse (windage) adjustment of fore stock rest 123. Rollers 515, seated in semi-cylindrical recess 517 of fore stock support plate 119 and rolling against the bottom surface of fore stock rest 123 provides stable transverse movement of fore stock rest 123 relative to fore stock support plate 119.

Figure 6:
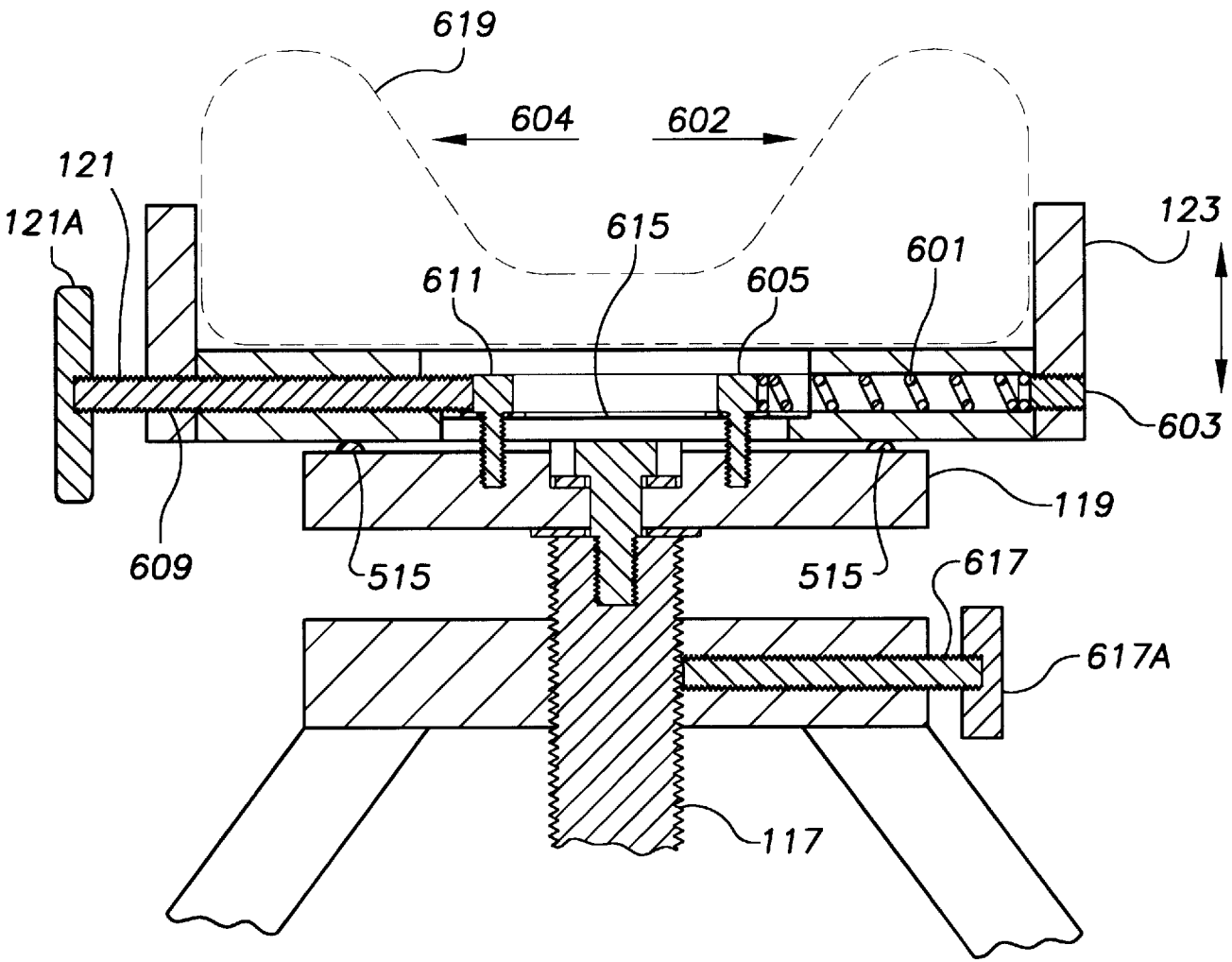
FIG. 6 is a detail front elevation drawing of the gun rest of FIG. 1 showing engagement of the windage adjustment screw and the elevation adjustment bias spring with respective set screws fixed to the fore stock support plate.

FIG. 6 is a cross section drawing of the upper portion of fore stock support assembly 103 taken along lines 6—6 of FIG. 5. Helical spring 601, compressed between end screw 603 and set screw 605, biases fore stock rest 123 in direction 602. Windage adjustment screw 121 engages threads 609 of fore stock rest 123 and pushes set screw 611 against spring pressure to drive rest 123 in direction 604. Rollers 515 provide low friction sliding support between support plate 119 and fore stock rest 123. Set screws 605 and 611, fixed into fore stock support plate 119 are slidably engaged in elongated slot 615 to allow transverse movement of rest 123 and attachment of rest 123 and support plate 119. Windage adjustment screw knob 121A provides convenient operation of the screw.

Elevation lock screw 617 locks elevation adjustment screw 117 to improve stability of fore stock rest 123. Elevation lock screw knob 617A provides convenient manipulation of the screw. In the preferred embodiments, fore stock rest shoe 619 provides improved support and grip of the fore stock of the gun. Shoe 619 may be made of fabric and filled with a packing material such as dry sand. A butt stock rest shoe (not shown) provides added grip to butt stock rest 129.

In the preferred embodiments, the major structural support components such as legs 111 and 113, butt stock rest assembly 105, fore stock rest 123, fore stock support plate 119 and tripod support plate 115 are made of aluminum. Adjustment screws, set screws, and helical spring 601 are made of steel. Adjustment knobs are made of plastic. In other embodiments, structural support components are made of steel or engineered plastics.

Accordingly, the reader will see that the gun rest disclosed and claimed provides a rest which provides repeatable results for accurate adjustment of gun sights and other factors affecting bullet trajectory. The gun sight provides the following additional advantages:

A pivoted connecting beam provides adjustment of butt stock height independent of fore stock height;

Longitudinal adjustment of the butt stock support allows use with different gun designs;

Leg attachment holes provide stable attachment of the rest to a support surface;

Elevation and windage adjustments are made at the fore stock support assembly and are independent of butt stock position;

The device is adaptable for use with handguns as well as rifles; and

The device is simple and low in cost.

Although the description above contains many specifications, these should not be construed as limiting the scope of the invention but merely providing illustrations of some of the presently preferred embodiments of this invention. For example, the device may be adapted for use on the ground instead of a support bench or table.

Thus the scope of the invention should be determined by the appended claims and their legal equivalents, rather than by the examples given.

I claim:

1. A gun rest for use with a horizontal support surface, the gun rest comprising:

a fore stock support assembly comprising a fore stock support rest connected to a plurality of fore stock support legs engageable with the support surface;

a connecting beam comprising a first end portion pivotally connected about a horizontal axis to the fore stock support assembly;

a butt stock support assembly comprising a butt stock rest disposed vertically on a second end portion of the connecting beam; and a connecting beam support assembly attached to the connecting beam and comprising a support surface engagement element engageable to the support surface.

2. The gun rest of claim 1 wherein the connecting beam support assembly is disposed on the second end portion of the connecting beam.

3. The gun rest of claim 1 wherein the connecting beam support assembly is disposed between a pin pivotally connecting the connecting beam to the fore stock support assembly and the butt stock support assembly.

4. The gun rest of claim 1 wherein the fore stock support assembly comprises three legs engageable to the support surface.

5. The gun rest of claim 1 wherein the fore stock support assembly comprises an elevation adjustment screw engageable with the fore stock support rest for adjusting a height of the fore stock support rest.

6. The gun rest of claim 1 wherein the fore stock support assembly comprises a windage adjustment screw engageable with the fore stock support rest for adjusting a lateral position of the fore stock support rest.

7. The gun rest of claim 1 wherein the fore stock support assembly comprises three support legs engageable to the support surface and the connecting beam is pivotally attached to a lower portion of one of said three support legs.

8. The gun rest of claim 1 wherein the second end portion of the connecting beam comprises a plurality of attachment elements for attaching the butt stock support assembly to a plurality of longitudinal positions along the connecting beam.

9. The gun rest of claim 1 wherein the connecting beam support assembly comprises a butt stock height adjustment screw engageable with complementary threads disposed on the connecting beam.

10. The gun rest of claim 1 wherein the butt stock rest of the butt stock support assembly comprises a U-shaped butt rest portion attached to the connecting beam by a butt rest extension, and a first height of the butt extension being at least equal to a second height of the U-shaped butt rest portion.

11. The gun rest of claim 10 wherein the first height of the butt extension is at least 1.5 times the second height of the U-shaped butt rest portion.

12. The gun rest of claim 10 wherein the first height of the butt extension is at least 2 times the second height of the U-shaped butt rest portion.

13. The gun rest of claim 7 comprising a hand gun butt rest connected to said one of said three support legs.

14. A gun rest for use with a generally horizontal support surface, the gun rest comprising:

a fore stock support assembly comprising a fore stock support rest connected to three fore stock support legs engageable with the support surface;

a connecting beam comprising a first end portion pivotally connected about a horizontal axis to a lower portion of at least one of said three fore stock support legs;

a butt stock support assembly comprising a butt stock rest disposed vertically on a second end portion of the connecting beam;

a butt height adjustment screw engaging complementary threads disposed on the connecting beam, the butt height adjustment screw comprising a first end engageable to the support surface for adjusting the height of the butt stock support assembly.

15. The gun rest of claim 14 wherein the fore stock support assembly comprises an elevation adjustment screw engageable with the fore stock support rest for adjusting a height of the fore stock support rest and a windage adjustment screw engageable with the forest stock support rest for adjusting a lateral position of the fore stock support rest.

16. A gun rest for use with a support surface, the gun rest comprising:

a fore stock support assembly comprising a fore stock support rest connected to a fore stock support leg engageable with the support surface;

a connecting beam comprising a first end portion pivotally connected to the fore stock support assembly;

a butt stock support assembly comprising a butt stock rest disposed vertically on a second end portion of the connecting beam; and a means for adjusting the height of the connecting beam from the support surface independent of a height of the fore stock support rest.

17. The gun rest of claim 16 wherein the means for adjusting the height of the connecting beam from the support surface comprises an adjusting screw engaging complementary threads on the connecting beam and an end portion of the adjusting screw engageable with the support surface.

18. The gun rest of claim 16 comprising a butt stock support longitudinal position adjustment means for adjusting the longitudinal position of the butt stock support assembly along the connecting beam.

* * * * *